US011125229B2

(12) United States Patent
Cuneo

(10) Patent No.: US 11,125,229 B2
(45) Date of Patent: Sep. 21, 2021

(54) AUTOMOTIVE VARIABLE MECHANICAL LUBRICANT PUMP

(71) Applicant: PIERBURG PUMP TECHNOLOGY GMBH, Neuss (DE)

(72) Inventor: Carmine Cuneo, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 249 days.

(21) Appl. No.: 16/340,689

(22) PCT Filed: Oct. 12, 2016

(86) PCT No.: PCT/EP2016/074405

§ 371 (c)(1),
(2) Date: Apr. 10, 2019

(87) PCT Pub. No.: WO2018/068841

PCT Pub. Date: Apr. 19, 2018

(65) Prior Publication Data

US 2019/0293069 A1 Sep. 26, 2019

(51) Int. Cl.
*F04C 14/22* (2006.01)
*F01C 21/10* (2006.01)
(Continued)

(52) U.S. Cl.
CPC ..... *F04C 14/22* (2013.01); *F01C 21/10* (2013.01); *F01M 1/16* (2013.01);
(Continued)

(58) Field of Classification Search
CPC ..... F04C 14/22; F04C 2/344; F04C 14/223; F04C 14/24; F01C 21/10; F01M 1/16;
(Continued)

(56) References Cited

U.S. PATENT DOCUMENTS 10,024,207 B2 7/2018 Celata et al.
2003/0231965 A1 12/2003 Hunter et al.
(Continued)

FOREIGN PATENT DOCUMENTS

CN 103835940 A 6/2014
CN 105264230 A 1/2016
(Continued)

*Primary Examiner* — Jacob M Amick
(74) *Attorney, Agent, or Firm* — Norman B. Thot

(57) ABSTRACT

A mechanical lubricant pump includes a control ring which shifts between a maximum and a minimum eccentricity position, the control ring having a circumference with anti-spring and pro-spring hydraulic surfaces, a pump rotor having slidable vanes which rotate in the control ring, a preload spring which pushes the control ring into the maximum eccentricity position, a hydraulic pilot chamber which pushes the control ring into the minimum eccentricity position, a hydraulic pressure control circuit which controls a gallery pressure by regulating a pilot chamber pressure, and a hydraulic outlet chamber which surrounds a part of the circumference. The hydraulic pilot chamber is charged with a pump outlet pressure or with the gallery pressure of an engine. The hydraulic outlet chamber is charged with the pump outlet pressure and is connected to the pump outlet for a pressurized lubricant. The anti-spring hydraulic surface is larger than the counter-acting pro-spring hydraulic surface.

15 Claims, 4 Drawing Sheets

(51) Int. Cl.

| | |
|---|---|
| ***F01M 1/16*** | (2006.01) |
| ***F04C 2/344*** | (2006.01) |
| ***F04C 14/24*** | (2006.01) |
| ***F01M 11/00*** | (2006.01) |
| ***F01M 11/04*** | (2006.01) |
| *F01M 1/02* | (2006.01) |

(52) U.S. Cl.
CPC ..... *F01M 11/0004* (2013.01); *F01M 11/04* (2013.01); *F04C 2/344* (2013.01); *F04C 14/223* (2013.01); *F04C 14/24* (2013.01); *F01M 2001/0238* (2013.01); *F01M 2001/0246* (2013.01)

(58) Field of Classification Search
CPC ..... F01M 11/0004; F01M 11/04; F01M 2001/0238; F01M 2001/0246
See application file for complete search history.

(56) References Cited

U.S. PATENT DOCUMENTS

| | | | | |
|---|---|---|---|---|
| 2004/0247463 | A1 | 12/2004 | Kiefer | |
| 2008/0069704 | A1 | 3/2008 | Armenio et al. | |
| 2014/0030120 | A1* | 1/2014 | Cuneo ..... | F04B 17/05 417/364 |
| 2014/0219847 | A1 | 8/2014 | Watanabe et al. | |
| 2016/0115832 | A1 | 4/2016 | Celata et al. | |
| 2016/0153325 | A1 | 6/2016 | Saga | |
| 2016/0290335 | A1 | 10/2016 | Cuneo et al. | |

FOREIGN PATENT DOCUMENTS

| | | | |
|---|---|---|---|
| CN | 105960531 | A | 9/2016 |
| EP | 1 350 930 | A1 | 10/2003 |
| JP | 2016-104967 | A | 6/2016 |
| WO | WO 2014/187503 | A1 | 11/2014 |

* cited by examiner

AUTOMOTIVE VARIABLE MECHANICAL LUBRICANT PUMP

CROSS REFERENCE TO PRIOR APPLICATIONS

This application is a U.S. National Phase application under 35 U.S.C. § 371 of International Application No. PCT/EP2016/074405, filed on Oct. 12, 2016. The International Application was published in English on Apr. 19, 2018 as WO 2018/068841 A1 under PCT Article 21(2).

FIELD

The present invention relates to an automotive variable mechanical lubricant pump for providing pressurized lubricant for an internal combustion engine.

BACKGROUND

An automotive variable mechanical lubricant pump is mechanically driven by the internal combustion engine. The mechanical lubricant pump is designed as a positive displacement pump and is provided with a pump rotor with numerous slidable rotor vanes which rotate within a shiftable control ring which is slidable between a maximum eccentricity position and a minimum eccentricity position. The rotor vanes separate the pumping chamber into numerous pumping compartments. The compartment stroke is varied by increasing or decreasing the eccentricity of the control ring with respect to the pump rotor. Since the compartment stroke is variable, the pump outlet pressure can be controlled and kept more or less constant independently of the rotational speed of the lubricant pump.

It is in practice advantageous to control the so-called lubricant gallery pressure at the engine because the lubricant gallery pressure is the parameter which is decisive for a sufficient lubrication of the engine.

A relatively simple and cost-effective construction provides the mechanical lubricant pump with one control ring preload spring to push the control ring into the maximum eccentricity position with the highest compartment stroke and with one single counter-acting hydraulic pilot chamber to push the control ring into the minimum eccentricity position. The pilot control chamber is directly charged with the pump outlet pressure or with the gallery pressure. The hydraulic pressure in the pilot chamber can be controlled by a separate hydraulic control valve which regulates the hydraulic control chamber pressure. The separate hydraulic control valve can be regulated dependent on the engine's gallery pressure to keep the gallery pressure constant.

It is not generally a significant problem that the actual pressure value is picked up remotely from the pump outlet. However, when the engine is started after having stood still, the engines and the pumps hydraulic system is empty and is only successively filled with the pressurized lubricant. The detected gallery pressure is therefore very low at the beginning of the starting procedure so that the control ring stays in the maximum eccentricity position until the lubricant has arrived at the engine's gallery and until the separate hydraulic control valve is charged with the real lubricant's gallery pressure. The mechanical lubricant pump therefore runs with a maximum eccentricity as long as the lubricant has not arrived at the pickup location of the gallery pressure. As long as the hydraulic pressure control circuit is not filled and is not working properly, and if the lubricant is cold and/or the rotational speed of the pump rotor is relatively high, a hydraulic overpressure can occur in the pumping compartments which could damage or destroy the rotor vanes and the engine components, such as filter(s) or the cooler.

SUMMARY

An aspect of the present invention is to provide an automotive variable mechanical lubricant pump with a relatively simple control circuit and with an arrangement for avoiding overpressure during the engine's starting procedure.

In an embodiment, the present invention provides an automotive variable mechanical lubricant pump for providing a pressurized lubricant for an internal combustion engine. The automotive variable mechanical lubricant pump includes a control ring configured to be shiftable in a control ring sifting direction between a maximum eccentricity position and a minimum eccentricity position, the control ring comprising an outer control ring circumference which comprises an effective anti-spring hydraulic surface and a pro-spring hydraulic surface, a pump rotor comprising a plurality of slidable vanes which are configured to rotate in the control ring, a control ring preload spring configured to push the control ring into the maximum eccentricity position, a hydraulic pilot chamber configured to push the control ring into the minimum eccentricity position, a hydraulic pressure control circuit configured to control a gallery pressure by directly regulating a pilot chamber pressure, a pump outlet for the pressurized lubricant, and a dissymmetric hydraulic outlet chamber which is arranged to surround a part of the outer control ring circumference. The hydraulic pilot chamber is charged with a pump outlet pressure or with a gallery pressure of the internal combustion engine. The dissymmetric hydraulic outlet chamber is directly charged with the pump outlet pressure and is directly connected to the pump outlet for the pressurized lubricant. The effective anti-spring hydraulic surface in the dissymmetric hydraulic outlet chamber is larger than the pro-spring hydraulic surface which counter acts the effective anti-spring hydraulic surface.

BRIEF DESCRIPTION OF THE DRAWINGS

The present invention is described in greater detail below on the basis of embodiments and of the drawings in which.

DETAILED DESCRIPTION

Figure 1:
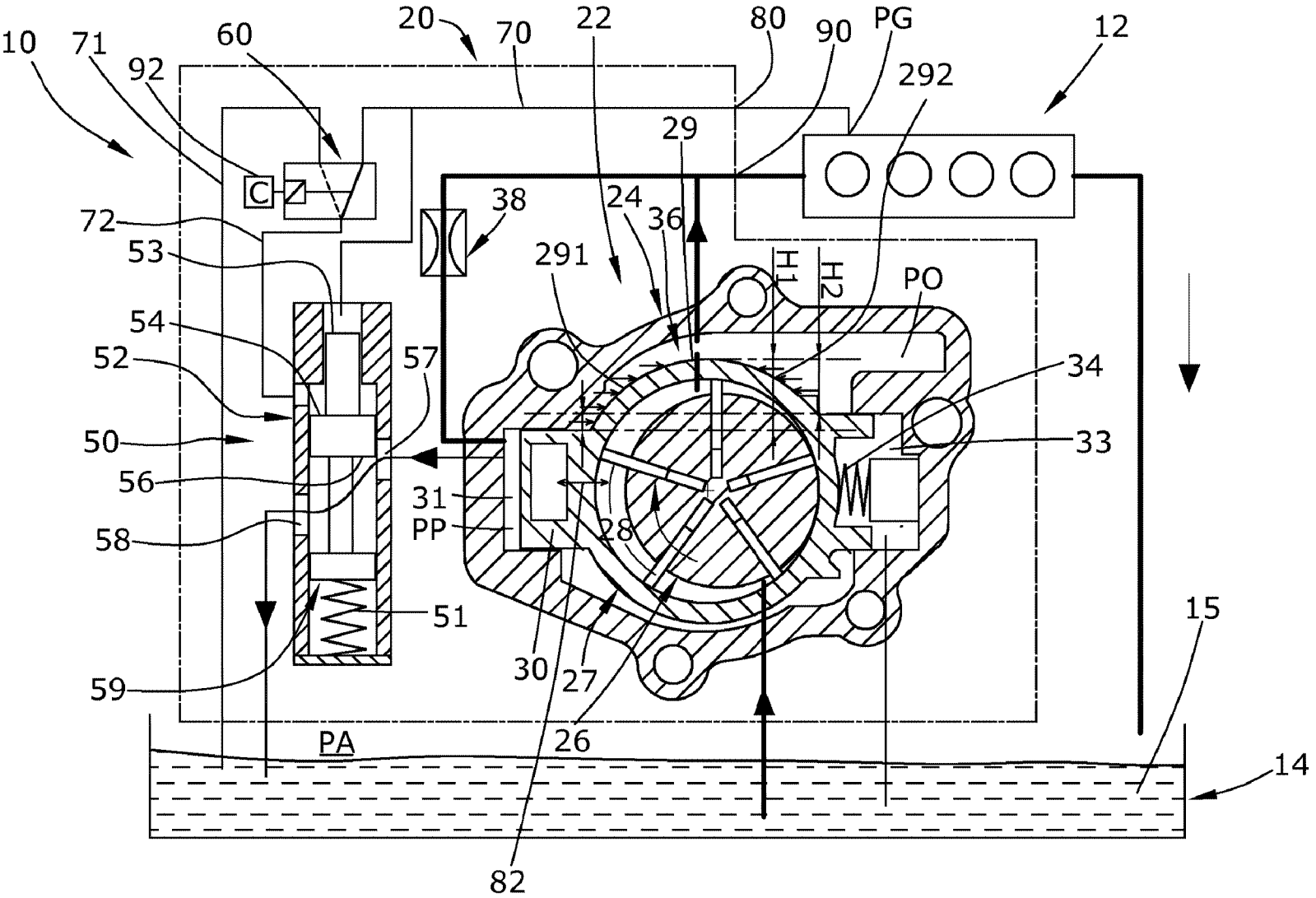
FIG. 1 schematically shows an embodiment of a control circuit with an automotive variable mechanical lubricant pump, an engine which is supplied with pressurized lubricant coming from the lubricant pump, a pump control chamber being directly charged with the pump outlet pressure, and a hydraulic control valve, in a low set-pressure condition.

The lubricant pump of the present invention is provided with a pump rotor with numerous slidable vanes which rotate in a control ring which is shiftable between a maximum eccentricity position and a minimum eccentricity position. The control ring encloses a pumping chamber where the pumping action takes place. The pumping chamber is divided by the slidable vanes into numerous pumping compartments.

The control ring can be provided to be linearly shiftable or, alternatively, to be pivotable. The term "eccentricity" refers to the distance between the rotation axis of the pump rotor and the middle of the inner circumference of the control ring. The inner circumference of the control ring can be precisely circular or can have a non-circular form. The middle of the control ring is, however, the geometric middle. The compartment stroke is low at low control ring eccentricity, and the compartment stroke is high at high control ring eccentricity.

The lubricant pump is provided with a control ring preload spring for pushing the control ring into the maximum eccentricity direction and with a hydraulic pilot chamber which pushes the control ring into the minimum eccentricity direction against the force of the preload spring. The hydraulic pilot chamber is charged directly with the pump outlet pressure or the gallery pressure, and the hydraulic pressure in the pilot chamber is adjusted and regulated by a hydraulic control circuit which is charged with a remote gallery pressure of the engine via an actual-pressure inlet. In other words, the actual-pressure in the control chamber is controlled at least temporarily by the control circuit dependent on the remote gallery pressure.

A part of the outer circumference of the control ring is surrounded by a hydraulic outlet chamber which is directly filled with pressurized lubricant coming from the pumping compartments through a pumping chamber outlet opening. The pumping chamber outlet opening can be provided in the control ring and/or in a pumping chamber side wall lying in a cross-section of the lubricant pump. The pressurized lubricant flows from the outlet chamber directly to the pump outlet for the pressurized lubricant, from where the pressurized lubricant flows to the engine's gallery. In other words, the hydraulic outlet chamber is an intermediate room through which the pressurized lubricant coming from the pumping chamber flows through on its way to the engine, so that the outlet chamber is filled with pressurized lubricant right after the start of the engine.

According to the present invention, the effective anti-spring hydraulic surface of the control ring circumference in the hydraulic outlet chamber is larger than the counter-acting pro-spring hydraulic surface. The effective hydraulic surface is the control ring area within the outlet chamber as seen in the control ring's shifting direction. The anti-spring hydraulic surface and the pro-spring hydraulic surface in prior art pumps are equal so that the hydraulic pressure in the outlet chamber has no influence on the pump pressure control circuit.

The present invention provides that the two effective hydraulic outlet chamber surfaces are not equal. Since the anti-spring hydraulic surface is larger than the pro-spring hydraulic surface within the outlet chamber, a resulting anti-spring force pushes the control ring into the low eccentricity direction against the spring force if a lubricant overpressure is present, namely, a pressure higher than atmospheric pressure. The higher the hydraulic overpressure in the outlet chamber is, the higher is the total force directed into the low eccentricity direction. As a result, the control ring is pushed and moved into the low eccentricity direction if the hydraulic pressure in the outlet chamber is very high so that damage to the vanes or engine components is avoided. This mechanism is effective and active immediately after the start of the engine because, after the pumping chamber has been filled with lubricant, the first room hydraulically downstream of the pumping chamber is the outlet chamber which is filled with the pressurized lubricant immediately after the engine's start. The dissymmetric outlet chamber thereby protects the lubricant pump against an overpressure of the pressurized lubricant in the pumping chamber which is too high so that the vanes are in particular protected against damage caused by overpressure in the pumping compartments.

In an embodiment of the present invention, no other additional hydraulic control chamber can, for example, be provided or has a relevant direct effect on the position and movement of the control ring, except the pilot chamber and the outlet chamber. No additional overpressure valve is therefore necessary to avoid overpressure.

In an embodiment of the present invention, the hydraulic pressure control circuit can, for example, be provided with a separate hydraulic control valve which is charged with the remote gallery pressure. The hydraulic control valve is provided with a valve plunger, the position of which is defined by the charged gallery pressure.

In an embodiment of the present invention, the projected height of the hydraulic anti-spring surface, as seen in a plane perpendicular to the control ring's shifting direction, can, for example, be larger than the corresponding pro-spring hydraulic surface height. The respective height value results from the projection of the outer circumference of the control ring within the hydraulic outlet chamber to a plane perpendicular to the shifting direction. Since the axial extent of the control ring is equal all over its complete circumference, only the projected heights of the control ring cause the difference of the hydraulic surface of the control ring circumference.

In an embodiment of the present invention, the effective anti-spring hydraulic surface can, for example, be at least 10% larger, for example, at least 20% larger, than the pro-spring hydraulic surface. The difference can, for example, be less than 100% because the total force generated in the hydraulic outlet chamber should not become too strong.

In an embodiment of the present invention, the hydraulic control valve can, for example, be provided with a plunger comprising a valve body for opening and closing a valve opening, with a valve preload spring for pushing the valve body into the open valve position, and with a first active plunger surface which is charged with the gallery pressure of the pump's actual-pressure inlet. The hydraulic control valve is a pure hydraulic control valve which is not directly electrically actuated. The valve preload spring pushes the valve body into the open valve position. The gallery pressure of the engine which is charged to the first active plunger surface causes the plunger to be pushed into the closed valve position against the valve preload spring.

If the gallery pressure at the first active plunger surface is high, the valve opening is small or closed, and if the gallery pressure is relatively low, the valve opening is relatively wide open or is completely open. When the engine is started, the hydraulic control circuit is normally empty and only filled with air at atmospheric pressure. The valve opening is therefore completely open when the engine is started so that no relevant pressure is present in the hydraulic pilot chamber.

In an embodiment of the present invention, the hydraulic control valve can, for example, be provided downstream of the hydraulic pilot chamber so that the pressure in the hydraulic pilot chamber is low if the control valve is open, and the pressure in the pilot chamber is high when the control valve is closed. A hydraulic throttle can, for example, be provided in this embodiment which is upstream of the pilot chamber and downstream of the source of the pump outlet pressure which is normally the hydraulic outlet chamber.

It is generally possible, however, that, alternatively, the hydraulic control valve is provided upstream of the pilot chamber and the throttle is provided downstream of the pilot chamber.

In an embodiment of the present invention, the control valve plunger can, for example, comprise a second active plunger surface which is charged with the gallery pressure of the pressure inlet via a separate hydraulic switch which is electrically actuated. The second active plunger surface is connected to atmospheric pressure or to the gallery pressure, dependent on the switching status of the hydraulic switch. Two different set-pressures can therefore be chosen. The electrically actuated hydraulic switch is controlled by an electronic pump control which can be a part of an engine control. The electronic pump control selects the set pressure dependent on numerous conditions, for example, the lubricant temperature, the atmospheric air temperature, the engine's rotational speed etc.

Embodiments of the present invention are described below under reference to the enclosed drawings.

The drawings show an arrangement 10 of an automotive variable mechanical lubricant pump 20, an internal combustion engine 12, and a lubricant tank 14 with a liquid lubricant 15, namely, engine oil. The liquid lubricant 15 in the lubricant tank 14 is sucked by the lubricant pump 20 and is delivered as a pressurized lubricant to the engine 12 for lubrication and cooling of the engine 12.

Figure 2:
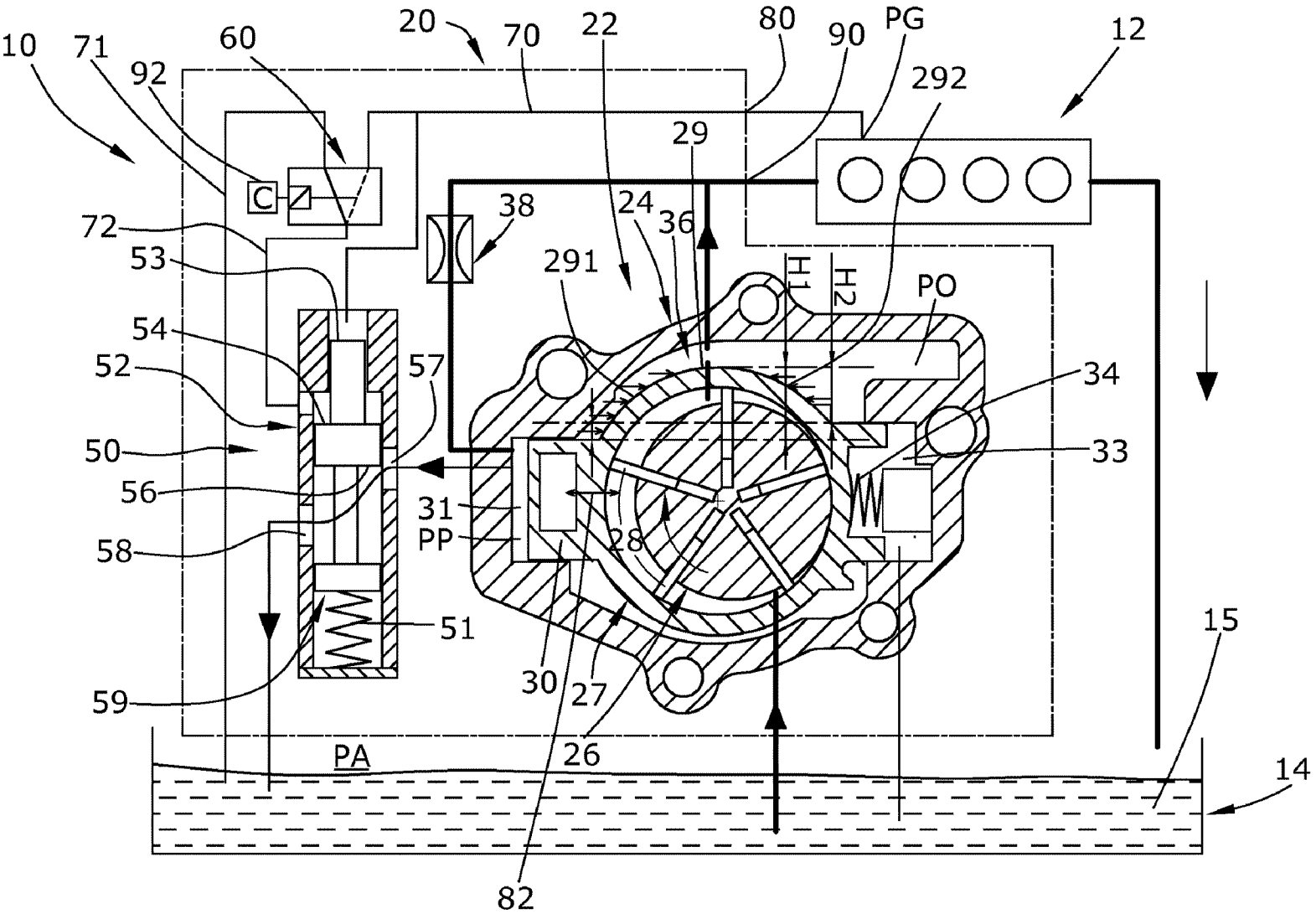
FIG. 2 shows the lubricant pump of FIG. 1 in a high set-pressure condition.

The lubricant pump 20 of the embodiment shown in FIGS. 1 and 2 comprises a pumping unit 22, a hydraulic control valve 50, and a hydraulic switch 60, which can be integrated together in one single lubricant pump device. The pumping unit 22 is provided with a rotatable pump rotor 26 with five radially slidable rotor vanes 28 which rotate in a linearly shiftable control ring 27. The pump rotor 26 is directly mechanically driven by the engine 12. The control ring 27 is linearly shiftable in a control ring shifting direction 82. The control ring 27 encloses a pumping chamber which is divided into five pumping compartments via the rotor vanes 28. The pump rotor 26 rotates in clockwise direction in the shown embodiment.

The control ring 27 is shiftable between a maximum eccentricity position as shown in FIGS. 1 and 2 providing a maximum compartment stroke, and a minimum eccentricity position providing a minimum compartment stroke. In the maximum eccentricity position of the control ring 27, the pumping performance is maximized, whereas in the minimum eccentricity position of the control ring 27, the pumping performance is minimized. The control ring 27 is arranged to be linearly shiftable within a pumping unit housing 24 which supports the control ring 27. The control ring 27 is pushed by a control ring preload spring 34 into the maximum eccentricity position, as shown in the drawings. The control ring preload spring 34 is provided in a spring chamber 33 which is hydraulically connected to the lubricant tank 14 and which is generally under atmospheric pressure PA.

A hydraulic pilot chamber 31 is provided opposite to the spring chamber 33. The hydraulic pilot chamber 31 is defined by the pumping unit housing 24 and by a pilot chamber piston 30 which is a part of the body of the control ring 27. If the hydraulic pilot chamber 31 is charged with the pressurized lubricant, the control ring 27 is pushed into the minimum eccentricity position against the control ring preload spring 34.

The lubricant which is pumped and pressurized in the pumping chamber and in the pumping compartments is directly discharged from the pumping chamber to a hydraulic outlet chamber 36 which is defined by a sector of the circular outside circumference 29 of the control ring 27 and by the pumping unit housing 24. The pressure of the lubricant in the hydraulic outlet chamber 36 is the outlet pressure PO of the lubricant pump 20 which is the lubricant pressure at a pump outlet port 90.

The hydraulic outlet chamber 36 is designed dissymmetric so that the effective anti-spring hydraulic surface 291 of the circular outside circumference 29 of the control ring 27 in the hydraulic outlet chamber 36 is about 20% larger than the counter acting pro-spring hydraulic surface 292. The hydraulic surface 291, 292 is the projection of the control ring circumference surface within the hydraulic outlet chamber 36 seen exactly in the control ring shifting direction 82. As can be seen in FIG. 1, the anti-spring hydraulic surface height H1 perpendicular to the control ring shifting direction 82 is larger than the pro-spring hydraulic surface height H2.

An anti-spring force is accordingly generated if the lubricant in the hydraulic outlet chamber 36 is pressurized. The anti-spring force is the result of the hydraulic surface difference dA multiplied by the overpressure PO-PA with respect to atmospheric pressure. If the overpressure PO-PA is high enough, the control ring 27 is shifted into minimum eccentricity direction against the force of the control ring preload spring 34.

The hydraulic pilot chamber 31 is directly charged with lubricant having the pump's outlet-pressure PO via a hydraulic throttle 38. The hydraulic pilot chamber 31 is discharged via a valve inlet opening 57 and a valve outlet opening 58 of the hydraulic control valve 50 to atmospheric pressure PA. The hydraulic control valve 50 is provided with a valve housing 52 which is generally cylindrical inside. A complex valve plunger 59 comprising a cylindrical valve body 56 is provided axially shiftable within the valve housing 52. The valve plunger 59 is mechanically preloaded by a valve preload spring 51 which pushes the valve plunger 59 into the open valve position in which the hydraulic pilot chamber 31 is connected without restriction or fluidic resistance to the lubricant tank 14 which is under atmospheric pressure PA.

The valve plunger 59 is provided with a valve body 56 which steplessly completely covers, covers in part, or leaves completely open, the valve inlet opening 57 which is fluidically directly connected to the hydraulic pilot chamber 31. The valve outlet opening 58 is fluidically directly connected to the lubricant tank under atmospheric pressure PA.

The valve plunger 59 is provided with a first circular active plunger surface 53 and with a second circular active plunger surface 54. The first circular active plunger surface 53 is directly charged with the gallery pressure PG which is transferred from the engine 12 to the lubricant pump 20 through a pump gallery pressure inlet 80 and via an internal gallery pressure line 70. The second circular active plunger surface 54 is charged with the gallery pressure PG via a separate hydraulic switch 60 which is a ⅔ valve and via a hydraulic line 72 between the hydraulic switch 60 and the hydraulic control valve 50. The second circular active plunger surface 54 is charged with the gallery pressure PG or, alternatively, with atmospheric pressure PA, via a hydraulic line 71, depending on the switching status of the hydraulic switch 60.

The hydraulic switch 60 is electronically controlled by an electronic pump control 92 which controls the switching state of the hydraulic switch 60 dependent on the lubricant temperature and the rotational pump speed. The hydraulic switch 60 hydraulically connects the second circular active plunger surface 54 to gallery pressure PG if the set-value of the gallery pressure PG should be low, as shown in FIG. 1. If the set-value of the gallery pressure PG is relatively high, the hydraulic switch 60 is switched into the low pressure position to connect the second circular active plunger surface 54 to the atmospheric pressure PA of the lubricant tank 14, as shown in FIG. 2.

The position of the control ring 27 is the equilibrium position in which the spring force of the control ring preload spring 34 is more or less equal to the hydraulic force generated by the pilot chamber pressure PP in the hydraulic pilot chamber 31 plus the hydraulic force in shifting direction 82 caused by the lubricant outlet pressure PO in the hydraulic outlet chamber 36.

When the engine 12 is started after having stood still, the liquid lubricant 15 is sucked from the lubricant tank 14 into the pumping chamber where the lubricant is pumped by the pumping compartments to the hydraulic outlet chamber 36. If the lubricant is cold and has a relatively low viscosity, the lubricant's outlet pressure PO in the hydraulic outlet chamber 36 can be relatively high. In that case, the total lubricant pressure outlet pressure PO generates a force at the control ring 27 which is directed against the spring force of the control ring preload spring 34 and thereby moves the control ring 27 into the low eccentricity direction so that the compartment stroke of the lubricant pump 20 is reduced, with the result that the outlet pressure PO is reduced accordingly. As soon as the lubricant has arrived at the hydraulic pilot chamber 31 and at the hydraulic control valve 50, the pump pressure control works properly.

Figure 3:
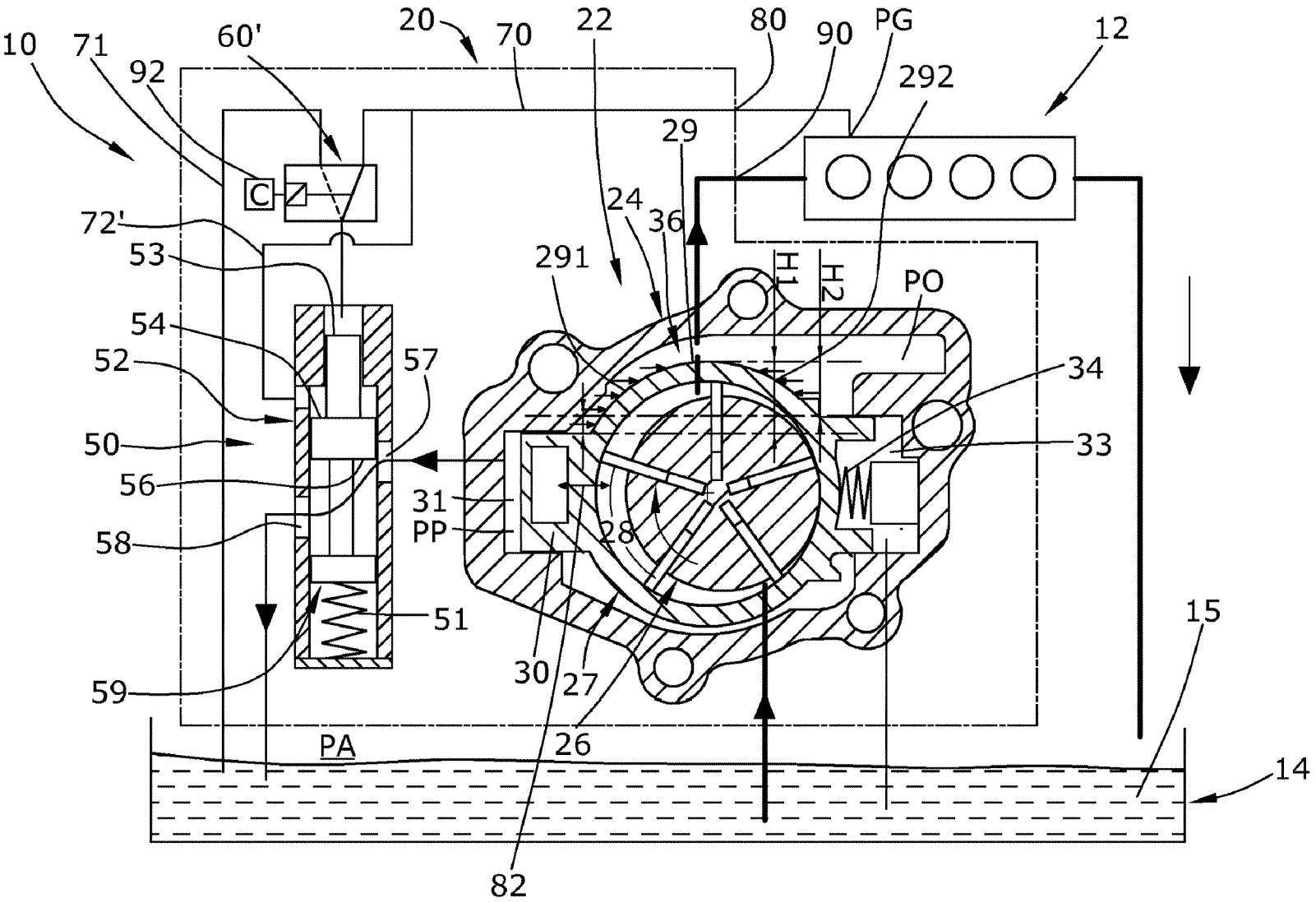
FIG. 3 shows an embodiment of the control circuit with the pump control chamber being charged with the gallery pressure via the hydraulic control valve.

The arrangement 10 according to the embodiment shown in FIG. 3 is similar to the embodiment shown in FIGS. 1 and 2. The hydraulic pilot chamber 31 in FIG. 3 is charged with the gallery pressure PG via the hydraulic control valve 50. The gallery pressure PG is directed by a hydraulic line 72' to a valve inlet of the hydraulic control valve 50 depending on the position of the valve plunger 59. The hydraulic pilot chamber 31 is charged with the gallery pressure PG or with the atmospheric pressure PA. The hydraulic switch 60' has a similar function as the arrangement shown in the embodiment of FIGS. 1 and 2. The hydraulic switch 60' charges the first circular active plungers surface 53 with the gallery pressure PG or, alternatively, with atmospheric pressure PA, to thereby define a second set outlet pressure PO.

Figure 4:
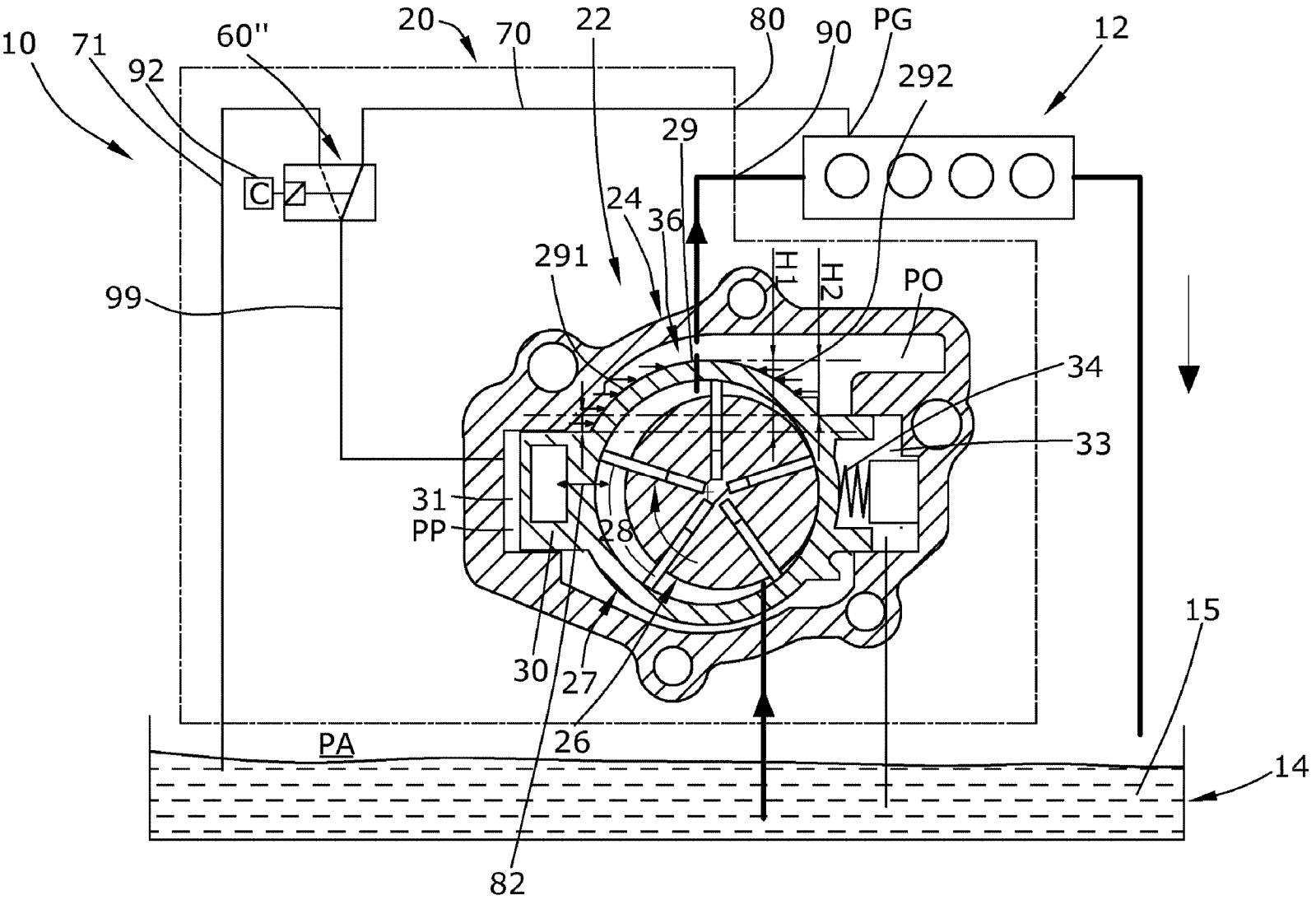
FIG. 4 shows an embodiment of the control circuit without a hydraulic control valve.

The arrangement 10 according to the embodiment shown in FIG. 4 is not provided with any hydraulic control valve. The hydraulic pilot chamber 31 is here directly charged with the gallery pressure PG or with atmospheric pressure PA via hydraulic line 99 depending on the switching position of the hydraulic switch 60".

No additional overpressure valve is provided in any of the embodiments of the arrangement 10.

The present invention is not limited to embodiments described herein; reference should be had to the appended claims.

What is claimed is:

1. An automotive variable mechanical lubricant pump for providing a pressurized lubricant for an internal combustion engine, the automotive variable mechanical lubricant pump comprising:

a control ring configured to be shiftable in a control ring sifting direction between a maximum eccentricity position and a minimum eccentricity position, the control ring comprising an outer control ring circumference which comprises an effective anti-spring hydraulic surface and a pro-spring hydraulic surface;

a pump rotor comprising a plurality of slidable vanes which are configured to rotate in the control ring;

a control ring preload spring configured to push the control ring into the maximum eccentricity position;

a hydraulic pilot chamber configured to push the control ring into the minimum eccentricity position, the hydraulic pilot chamber being charged with a pump outlet pressure or with a gallery pressure of the internal combustion engine;

a hydraulic pressure control circuit configured to control the gallery pressure by directly regulating a pilot chamber pressure;

a pump outlet for the pressurized lubricant; and a dissymmetric hydraulic outlet chamber which is arranged to surround a part of the outer control ring circumference, the dissymmetric hydraulic outlet chamber being directly charged with the pump outlet pressure and being directly connected to the pump outlet for the pressurized lubricant, wherein, the effective anti-spring hydraulic surface in the dissymmetric hydraulic outlet chamber is larger than the pro-spring hydraulic surface which counter acts the effective anti-spring hydraulic surface.

2. The automotive variable mechanical lubricant pump as recited in claim 1, further comprising:

an anti-spring hydraulic surface height arranged perpendicular to the control ring shifting direction; and a pro-spring hydraulic surface height arranged perpendicular to the control ring shifting direction, wherein, the anti-spring hydraulic surface height is larger than the pro-spring hydraulic surface height.

3. The automotive variable mechanical lubricant pump as recited in claim 1, wherein the effective anti-spring hydraulic surface is at least 10% larger than the pro-spring hydraulic surface.

4. The automotive variable mechanical lubricant pump as recited in claim 1, wherein the effective anti-spring hydraulic surface is at least 20% larger than the pro-spring hydraulic surface.

5. The automotive variable mechanical lubricant pump as recited in claim 1, further comprising:

a hydraulic control circuit comprising a hydraulic control valve which is configured to control the gallery pressure of the internal combustion engine by directly regulating the pilot chamber pressure, the hydraulic control valve comprising an actual-pressure inlet which is charged with the remote gallery pressure of the internal combustion engine.

6. The automotive variable mechanical lubricant pump as recited in claim 5, wherein the hydraulic control valve further comprises a plunger which comprises a valve body for opening and closing a valve opening and a first active plunger surface which is charged with the gallery pressure of the actual-pressure inlet, and a valve preload spring which is configured to push the valve body into an open valve position.

7. The automotive variable mechanical lubricant pump as recited in claim 6, further comprising:

a separate hydraulic switch which is configured to be electrically actuated, wherein, the valve plunger further comprises a second active plunger surface which is charged with the gallery pressure of the actual-pressure inlet via the separate hydraulic switch.

8. The automotive variable mechanical lubricant pump as recited in claim 1, further comprising:

a hydraulic throttle arranged upstream of the hydraulic pilot chamber and downstream of a source of the pump outlet pressure.

9. An automotive variable mechanical lubricant pump for providing a pressurized lubricant for an internal combustion engine, the automotive variable mechanical lubricant pump comprising:

a control ring configured to be shiftable in a control ring sifting direction between a maximum eccentricity position and a minimum eccentricity position, the control ring comprising an outer control ring circumference which comprises an effective anti-spring hydraulic surface and a pro-spring hydraulic surface;

a pump rotor comprising a plurality of slidable vanes which are configured to rotate in the control ring;

a control ring preload spring configured to push the control ring into the maximum eccentricity position;

a hydraulic pilot chamber configured to push the control ring into the minimum eccentricity position, the hydraulic pilot chamber being charged with a pump outlet pressure or with a gallery pressure of the internal combustion engine;

a hydraulic pressure control circuit configured to control the gallery pressure by directly regulating a pilot chamber pressure;

a pump outlet for the pressurized lubricant; and a dissymmetric hydraulic outlet chamber which is arranged to surround a part of the outer control ring circumference, the dissymmetric hydraulic outlet chamber being directly charged with the pump outlet pressure and being directly connected to the pump outlet for the pressurized lubricant, wherein, the effective anti-spring hydraulic surface in the dissymmetric hydraulic outlet chamber is larger than the pro-spring hydraulic surface which counter acts the effective anti-spring hydraulic surface, and the effective anti-spring hydraulic surface is at least 10% larger than the pro-spring hydraulic surface.

10. The automotive variable mechanical lubricant pump as recited in claim 9, further comprising:

an anti-spring hydraulic surface height arranged perpendicular to the control ring shifting direction; and a pro-spring hydraulic surface height arranged perpendicular to the control ring shifting direction, wherein, the anti-spring hydraulic surface height is larger than the pro-spring hydraulic surface height.

11. The automotive variable mechanical lubricant pump as recited in claim 9, wherein the effective anti-spring hydraulic surface is at least 20% larger than the pro-spring hydraulic surface.

12. The automotive variable mechanical lubricant pump as recited in claim 9, further comprising:

a hydraulic control circuit comprising a hydraulic control valve which is configured to control the gallery pressure of the internal combustion engine by directly regulating the pilot chamber pressure, the hydraulic control valve comprising an actual-pressure inlet which is charged with the remote gallery pressure of the internal combustion engine.

13. The automotive variable mechanical lubricant pump as recited in claim 12, wherein the hydraulic control valve further comprises a plunger which comprises a valve body for opening and closing a valve opening and a first active plunger surface which is charged with the gallery pressure of the actual-pressure inlet, and a valve preload spring which is configured to push the valve body into an open valve position.

14. The automotive variable mechanical lubricant pump as recited in claim 13, further comprising:

a separate hydraulic switch which is configured to be electrically actuated, wherein, the valve plunger further comprises a second active plunger surface which is charged with the gallery pressure of the actual-pressure inlet via the separate hydraulic switch.

15. The automotive variable mechanical lubricant pump as recited in claim 9, further comprising:

a hydraulic throttle arranged upstream of the hydraulic pilot chamber and downstream of a source of the pump outlet pressure.

* * * * *